United States Patent [19]

Weisbach et al.

[11] 4,343,462

[45] Aug. 10, 1982

[54] ROCKING AUXILIARY GRIPPER SYSTEM FOR SHEET PROCESSING MACHINES

[75] Inventors: Günter Weisbach, Radebeul; Günter Lucius, Dresden, both of German Democratic Rep.

[73] Assignee: VEB Kombinat Polygraph "Werner Lamberz" Leipzig, Leipzig, German Democratic Rep.

[21] Appl. No.: 151,111

[22] Filed: May 19, 1980

Related U.S. Application Data

[63] Continuation-in-part of Ser. No. 135,625, Mar. 31, 1980, abandoned.

[30] Foreign Application Priority Data

Apr. 2, 1979 [DD] German Democratic Rep. ... 211940

[51] Int. Cl.[3] ..... B65H 5/10; B65H 5/14

[52] U.S. Cl. ..... 271/267; 271/237; 271/194

[58] Field of Search ..... 271/267, 268, 236, 237, 271/238, 194, 84, 276, 277, 103, 226, 264, 269, 247, 242–244, 227, 228, 253–255

[56] References Cited

U.S. PATENT DOCUMENTS

| | | | |
|---|---|---|---|
| 2,193,300 | 3/1940 | Spiess | 271/247 |
| 2,642,282 | 6/1953 | Backhouse | 271/236 |
| 3,116,923 | 1/1964 | Gunther | 271/268 |
| 3,279,785 | 10/1966 | Linden | 271/194 X |
| 3,378,256 | 4/1968 | Ellis et al. | 271/183 |

FOREIGN PATENT DOCUMENTS

| | | | |
|---|---|---|---|
| 1163342 | 2/1964 | Fed. Rep. of Germany . | |
| 654490 | 4/1929 | France | 271/267 |
| 122239 | 9/1976 | German Democratic Rep. | |

*Primary Examiner*—Bruce H. Stoner, Jr.
*Attorney, Agent, or Firm*—Michael J. Striker

[57] ABSTRACT

The reciprocating auxiliary gripper system includes a parallel linkage the coupler of which supports a spring-biased gripper in the form of a suction head which is lifted upon application of suction to a spring space, so that the sheet performs during its transport from a take-over position on the feed table to a transfer position opposite a feed cylinder an additional movement superposed to the rocking movement of the linkage.

3 Claims, 4 Drawing Figures

ROCKING AUXILIARY GRIPPER SYSTEM FOR SHEET PROCESSING MACHINES

CROSS REFERENCE TO RELATED APPLICATION

This application is a continuation-in-part of our application Ser. No. 135,625, filed Mar. 31, 1980, now abandoned.

BACKGROUND OF THE INVENTION

This invention relates generally to sheet processing machines having a rotary sheet cylinder and a stationary feed table and more specifically it relates to a reciprocating auxiliary gripper system having a suction type gripper element.

Preferably, the sheet processing machine is a sheet fed rotary press in which the auxiliary gripper has the task to sieze a sheet located in an aligned position on the feed table, to accelerate the sheet and transfer the same to a clamping gripper on the periphery of the rotating feed cylinder.

In the GDR Pat. No. 122,239 a rocking preliminary gripper system is described which operates under the feed cylinder. The auxiliary gripper or sheet holding element in this known gripper system includes a movable gripper lip cooperating with a gripper stop movable on a circular path.

The disadvantage of this known gripper is the fact that its relatively large mass is subject to considerable inertial forces and moreover the control means for this gripper are prone to disturbing vibrations such as tangential or torsional vibrations. In order to keep the inertial forces low, the known clamping type gripper element is moved on a curved path having a relatively small radius. As a consequence, the sheet is moved on a strongly curved path which, however, is disadvantageous when extremely strong sheets (cartons) or extremely thin sheets (thin printing paper) are processed. The auxiliary gripper systems of this known construction are capable of performing their function in this case only when the plane of the feed table intersects the periphery of the subsequent feed cylinder.

From the German Pat. No. 1,163,342 a preliminary or auxiliary gripper is known, the sheet holding element of which is in the form of a suction element. It is true that this suction type gripper element removes the disadvantages of purely mechanical clamping grippers as far as the excessive inertial forces and disturbing vibrations of its control mechanism are concerned, but the sheet is still transferred from the feed table to the feed cylinder on a strongly curved path so that the aforementioned limits regarding the thickness of the processed paper sheets (cartons and thin printing papers) are still present. In addition, in the arrangement where the plane of the feed table intersects the feed cylinder, the alignment process of the subsequent sheet arriving on the feed table has the disadvantage of a relatively short time interval for such an alignment. This disadvantage results from the fact that the movable stops (front stops and top stops) upon aligning the sheet on the feed table must clear off the circular path of movement of the gripper element and can be swung up into their aligning position against the feed table only upon the passage of the front edge of the transported sheet past the point of intersection of the path of movement of the sheet and of the tip points of the marks. Consequently, in controlling the movement of the aligning stops, considerable rotary angles must be employed which are lost for the aligning process on the feed table.

SUMMARY OF THE INVENTION

It is, therefore, a general object of the present invention to overcome the aforementioned disadvantages.

More particularly, it is an object of the invention to provide an improved reciprocating auxiliary gripper system of the aforedescribed type which has a more simple structure.

An additional object of the invention is to provide such an improved gripper system which is suitable for processing all kinds of sheet material from the feed table to the feed cylinder without the danger of any damage to excessively rigid or excessively thin sheets.

A further object of the invention is to provide such an improved auxiliary gripper system the structure of which requires only a small mass and is not subject to disturbing vibrations normally resulting during the control of the sheet holding element.

Furthermore, it is an object of this invention to provide an auxiliary rocking gripper system which is suitable also for use in the arrangement of the sheet processing machine in which the feed table extends in a plane which is spaced apart about a certain distance from the path of movement of the clamping gripper on the periphery of the feed cylinder.

In keeping with these objects, and others which will become apparent hereafter, one feature of the invention resides, in an auxiliary gripper system having a suction element acting as the sheet holder, in the provision of a parallel linkage performing a reciprocating movement and the coupler of which supports the suction type sheet holding element. Preferably, the suction type element is in the form of a spring biased suction cup. The drive for the parallel linkage and thus for the suction type gripper element is effected in a conventional manner by using a cam drive.

By virtue of the provision of a spring biased suction element on the coupler of a parallel linkage, it is possible to impart to the suction element an additional movement apart from the swinging or rocking movement. In practice, the suction gripper element is guided on the path of movement of the coupler of the linkage, which fact has the advantage that the angle between the plane of the sheet on the feed table and the plane of suction of the gripper element is zero or negligibly small and consequently the holding forces exerted on the gripper are considerably reduced. For the same reason, the processing of extremely strong sheet material is made possible because in prior art devices, where the angle of deviation between the suction plane and the plane of the sheet is considerably larger, the danger of sheets "snapping away" from the suction element is considerably increased. The additional movement applied to the suction gripper element in addition to its rocking movement has furthermore the advantage that the auxiliary gripper system can be employed also in such an arrangement of the sheet processing machine where the plane of the feed table is spaced apart by a certain distance from the path of movement of the sheet holding element on the feed cylinder. A characteristic feature of the solution according to the invention is the fact that the path of movement of the front edge of the sheet between the feed table and the feed cylinder is not directed tangentially but is inclined relative to the plane of the feed table about an angle defined by structural parameters of the system. As a consequence, the point of intersection between the path of movement of the front edge of the sheet and the tips of the front stops is situated in proximity to the front alignment line for the sheets on the feed table and consequently the front stops need be rotated only through a relatively small rotational angle to give way to the sheet so that a larger time interval is available for the alignment of the sheets on the table. The auxiliary gripper of this invention is subject to very small inertial forces and any interfering vibrations which hitherto occur during the control of the reciprocating movement of the sheet holding element, are removed.

The employment of a spring controlled suction gripper element has the advantage that during the return phase of its reciprocating movement the element is retracted to move below the path of movement during the forward phase of the swing of the linkage and consequently a considerable freedom of arrangement of the feed table relative to the feed cylinder is attained.

The sheet is transported to the feed cylinder for the machine on a trajectory which has a relatively small curvature and therefore has the advantage that it can process both extremely rigid sheets (cartons) and extremely thin sheets (thin printing papers).

The novel features which are considered as characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENTS

Figure 1:
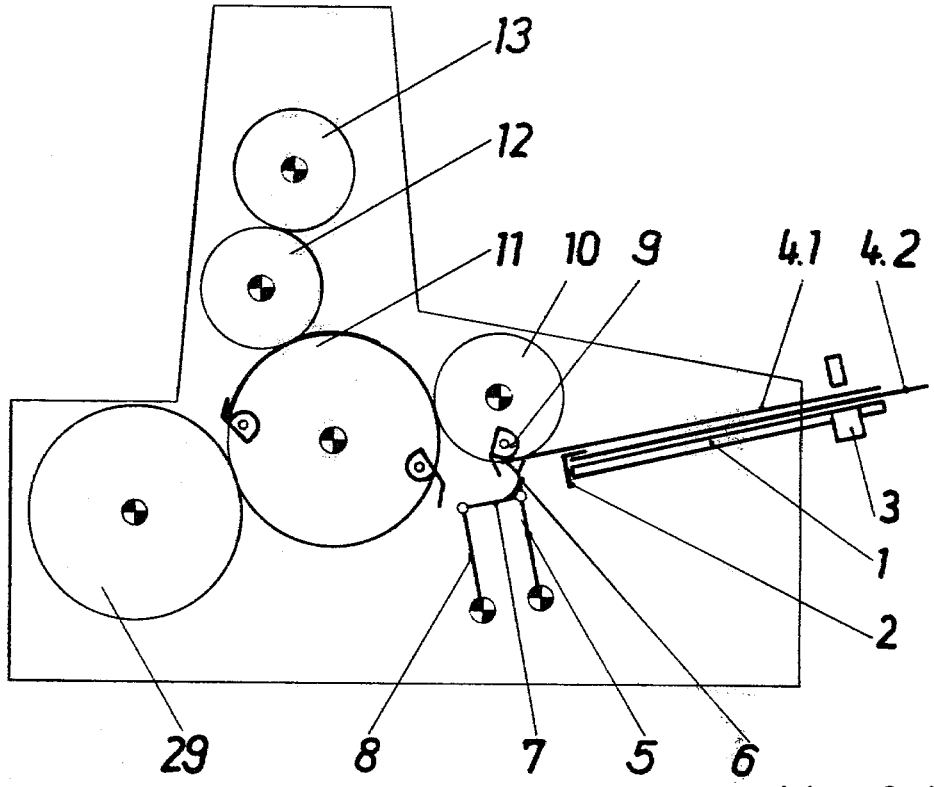
FIG. 1 shows schematically in a side view the first set of printing cylinders in cooperation with the auxiliary gripper system of this invention.

Referring firstly to FIG. 1, there is illustrated a feed table 1 cooperating with swingable front stops 2 at its front edge and having also lateral aligning device 3 for the sheets. The reciprocating gripper systems of this invention includes a parallel linkage assembled of parallel arms 5 and 8 supported respectively at one end for rotary movement and at the other end being interconnected by a coupler 7. The suction type gripping element 6 is fixedly mounted to the coupler 7 opposite the link arm 5. Above the suction gripper member 6 is situated the feed cylinder 10 with a clamping gripper 9 on its periphery. The feed cylinder 10 cooperates with the first set of printing rollers consisting of an impression cylinder 11, of a rubber or blanket cylinder 12 and a plate cylinder 13. The impression cylinder 11 also contacts a sheet discharge cylinder 29.

Figure 2:
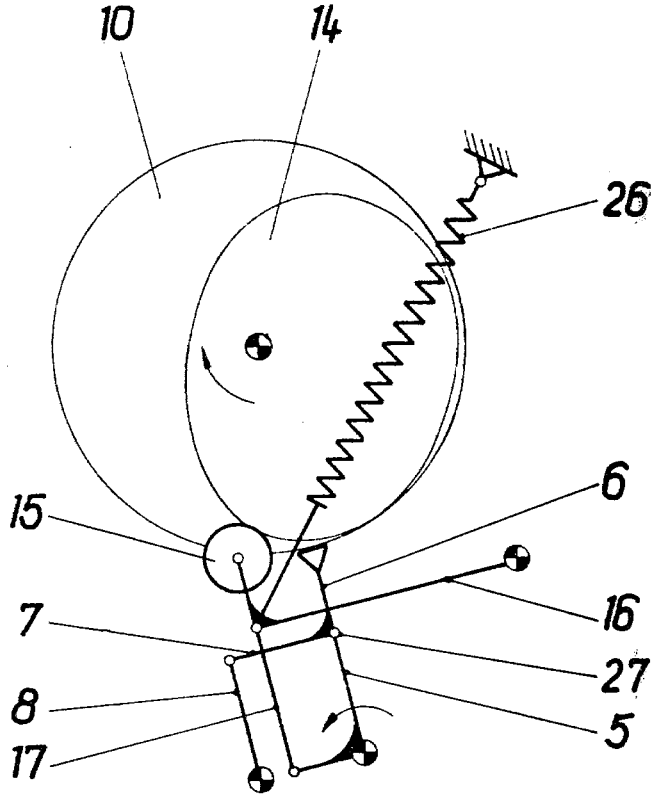
FIG. 2 is a schematic side view of the gripper system of this invention together with its reciprocating drive.

The drive of the auxiliary gripper system 6, as illustrated in FIG. 2, includes a driving cam 14 attached laterally to a face of the feed cylinder 10 and cooperating with a cam follower 15 to impart to the latter a rocking movement which is transmitted via a cam follower lever 16, a second coupler 17, the parallel linkage 5 and 8 to the first coupler 7 with the suction type gripper element 6. The engagement of the cam follower 15 and the cam surface 14 is ensured by a tension spring 26.

Figure 3:
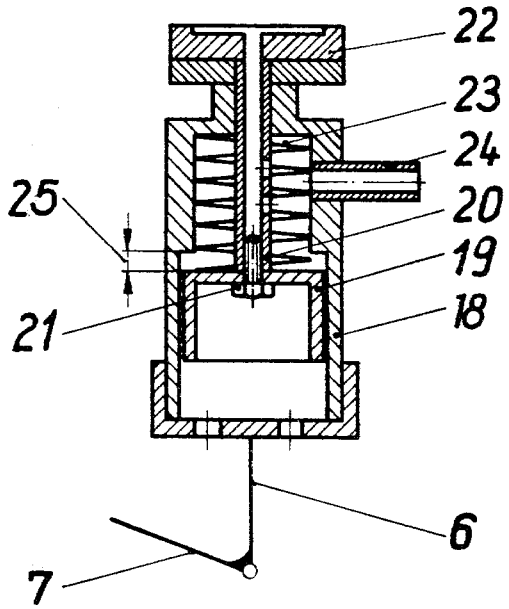
FIG. 3 is a sectional side view of a suction type spring biased gripper element of this invention.

The structure of the spring-biased, suction type gripper element 6 is shown in FIG. 3. The element 6 includes a housing 18 rigidly connected to the first coupler 7 and a piston 19 which is movable within the housing 18 is connected by a coupling pipe 20 to a suction head 22 secured for example by cementing to the projecting tip of the pipe 20. The lower end of the pipe 20 is secured to the top of the piston 19 by a screw 21. A pressure spring 23 urges the piston 19 and thus the suction head 22 into their lower or rest position. The space above the piston 19 is connected via conduit 24 and a non-illustrated control valve to a suction generator.

The operation of the auxiliary gripper system of this invention is as follows:

Sheets 4 are successively advanced in a known manner against the front stops 2 and are aligned thereon along their leading edge whereas the lateral aligning device 3 aligns the sheets according to their lateral edge. The aligned sheets are seized from below by the suction gripper 6 and are transferred to clamping gripper 9 on the feed cylinder 10 wherefrom are subsequently transferred to the impression cylinder 11, printed and discharged by the discharging cylinder 29.

Figure 4:
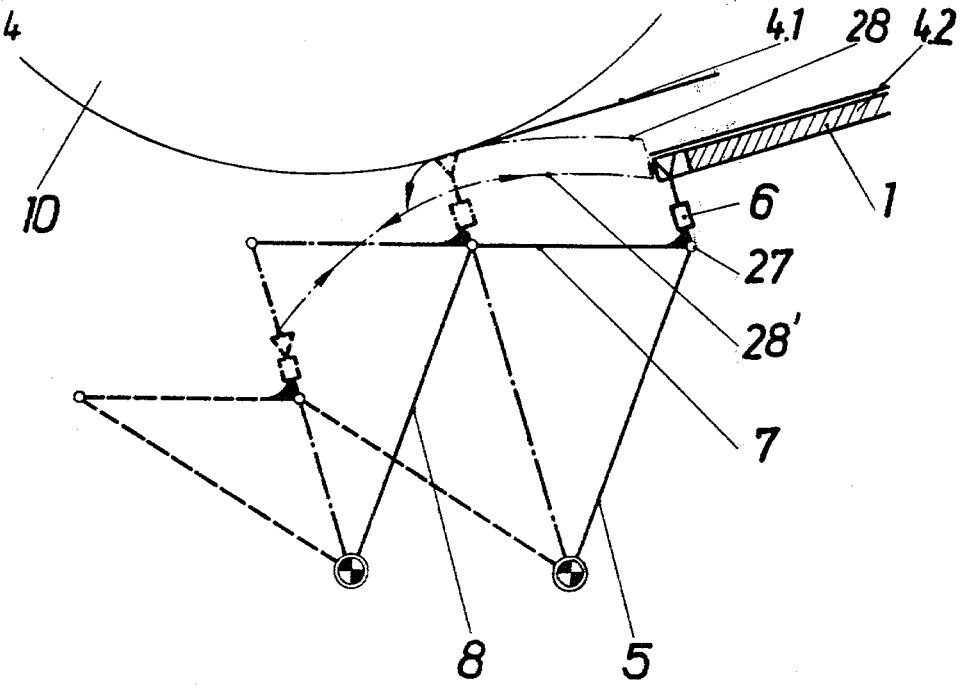
FIG. 4 shows schematically various phases of the movement of the gripper system of this invention.

Due to the rigid connection of the suction gripper 6 to the coupler 7 of parallel arms 5 and 8 which are hinged to the coupler at points 27, the gripper 6 performs a movement on a circular path 28' and by the action of piston 19 moving in the direction of the link arm 5 the suction gripper 6 performs a combined movement along the path 28 and 28' (FIG. 4). As soon as air is sucked out via the conduit 24 from the spring chamber in the housing 18 above the piston 19, and the suction head 22 which communicates with the spring chamber via openings in the connecting tube 20 faces the bottom of a sheet, the outer pressure displaces the piston 19 upwardly by a stroke 25 (FIG. 3). Referring again to FIG. 4, the "takeover" position of the suction gripper 6 in which the latter is situated below the front edge of the feed table 1 in contact with the bottom of the sheet 4.2, is illustrated in solid lines. As mentioned above, by supplying the suction in this takeover position, the piston 19 together with the suction head and the seized sheet 4.2 is displaced upwardly by the stroke 25 against the force of pressure spring 23. Immediately upon this upward movement the reciprocating drive of the linkage 5 and 8 accelerates the gripper system toward the periphery of the feed cylinder 10 and the transported sheet 4.1 is transferred on the path of the movement 28 to a "sheet transfer" working position illustrated by dash and dot lines in which the leading edge of the sheet 4.1 is displaced tangentially and with a synchronized speed to the clamping gripper 9 on the cylinder 10. Upon the completion of the transfer of the sheet 4.1 from the auxiliary gripper 6 to the clamping gripper 9 on the cylinder 10, the suction through the conduit 24 is interrupted and the compression spring 23 returns the movable parts of the suction gripper 6, namely the piston 19, connecting tube 20 and the suction head 22 to their lower position while the movement of the whole auxiliary gripper system continues in the same direction at a decelerating speed until a position "motion reversal" illustrated by dashed lines is attained.

From the latter position the whole gripper system is swung back to the aforementioned "takeover" position along the path 28' which is lower by the length of stroke 25 than the transfer path 28.

It will be understood that each of the elements described above, or two or more together, may also find a useful application in other types of constructions differing from the types described above.

While the invention has been illustrated and described as embodied in a suction type gripper system for use with a rotary press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An auxiliary gripper system for transferring sheets from a feed table to a feed cylinder of a sheet fed rotary press, comprising a parallel linkage arranged under the feed cylinder; a gripping mechanism secured to said linkage and including a suction-type gripping element which is movable relative to the linkage between a lower position and a raised position; drive means for oscillating said linkage between a sheet takeover position in which the gripping element is below said feed table and the linkage reverses its motion, and a sheet transfer position in which the gripping element passes below a transfer point of said feed cylinder at a speed synchronized with that of said transfer point; and means for displacing the gripping element relative to the linkage into its lower position when the linkage moves toward the sheet takeover position, and for lifting the gripping element relative to the linkage against said feed cylinder when the linkage moves from the takeover position to the sheet transfer position.

2. A gripper system as defined in claim 1, wherein said gripping mechanism includes a housing rigidly connected to said linkage, a piston movable in said housing and supporting the suction type gripping element; a pressure spring arranged in said housing in a space above said piston to urge the latter into a lower position; and suction means communicating with said space and with said suction head and being operable to lift said piston together with said gripping element when activated.

3. A gripper system as defined in claim 1, wherein said drive means includes a driving cam provided on said feed cylinder and a cam follower spring-biased against said cam and being coupled to said parallel linkage.

* * * * *